US005740772A

United States Patent [19]

Bluma

[11] Patent Number: 5,740,772

[45] Date of Patent: Apr. 21, 1998

[54] OIL FILTER COOLER

[75] Inventor: James S. Bluma, Colgate, Wis.

[73] Assignee: Midwest Instrument Co., Inc., Hartland, Wis.

[21] Appl. No.: 733,094

[22] Filed: Oct. 18, 1996

[51] Int. Cl.[6] ..... F01M 5/00

[52] U.S. Cl. ..... 123/196 AB; 123/41.33; 165/80.1; 165/916; 210/186

[58] Field of Search ..... 123/196 A, 196 AB, 123/41.33, 198 D; 165/916, 80.1; 210/186

[56] References Cited

U.S. PATENT DOCUMENTS

| | | | |
|---|---|---|---|
| 2,798,695 | 7/1957 | Arleque | 165/80.1 |
| 3,887,467 | 6/1975 | Johnson | 210/186 |
| 5,060,716 | 10/1991 | Heine | 165/80.1 |
| 5,305,824 | 4/1994 | Gasseling | 165/80.1 |
| 5,351,664 | 10/1994 | Rotter et al. | 123/196 AB |
| 5,363,823 | 11/1994 | Gittlein | 123/196 AB |
| 5,510,024 | 4/1996 | Caiozza | 210/186 |

*Primary Examiner*—Erick R. Solis
*Attorney, Agent, or Firm*—Ryan, Maki, Mann & Hohenfeldt

[57] ABSTRACT

A oil filter cooler involves a semi-circular or U-shaped metal device which simply "snaps" onto an oil filter due to the fact that it is slightly flexible, the device having radially extending fins extending outward which enable this device to draw heat away from the oil filter on which it is attached.

14 Claims, 2 Drawing Sheets

OIL FILTER COOLER

BACKGROUND OF THE INVENTION

The present invention involves an oil filter cooler for internal combustion engines. A typical internal combustion engine in an automobile has a firing rate of about 450,000 btu hours of gasoline. Approximately one third of that heat, or about 150,000 btu hours, is waste heat which must be taken off by the coolant and the engine oil. Roughly one half of that 150,000 btu, or about 75,000 btu, is taken up by the motor oil. This results in the motor oil running very hot anywhere from 210° F.–310° F. When the oil reaches these high temperatures it looses its ability to lubricate and protect the engine and also starts to carbonize. The oil's additives separate, forming deposits throughout the engine. The hotter the oil, the thinner it becomes and, therefore, the faster the volatile elements in the oil's composition vaporize. Once these components have vaporized, they are drawn off by the positive crank case ventilation system and permanently drawn out of the oil resulting in breakdown of the oil.

The prior art involves oil coolers which are installed on the vehicle's engine similar to that of a radiator on the front of the car. The cooling system must be connected to the engine coolant lubrication circuit with various hoses and clamps and is permanently attached to the front of the vehicle. A major drawback of such prior art oil coolant systems is that they are extremely expensive. A second problem involved with prior art coolant systems is difficulty of installation, requiring many special tools and excessive time. A third problem is that these oil coolers function twelve months out of the year, twenty-four hours a day. Therefore. even the weather drops below zero, this oil cooling system is still functioning, even though cooling of the oil is undesirable in this type of weather. Lastly, due to the complexity of such coolant systems, there is a greater opportunity for failure. Since this system is extremely complex, failure of its many components, including hoses, pipes, conduits, clamps, etc., results in oil leakage.

SUMMARY OF THE INVENTION

The present invention involves an oil filter cooler. Specifically, this invention involves a circular or U-shaped metal device which is slightly flexible and thereby simply "snaps" onto an oil filter. The device has radially extending fins extending outwardly from a heat conductive metal such which surrounds more than one-half, but less than the full circumference of the filter, which enables this device to draw heat away from the oil filter on which it is attached.

The present invention is of a very simple design which is quite inexpensive. The invention is extremely easy to install requiring only a few seconds to clip onto the oil filter. Attachment of the device to an oil filter does not require additional equipment, such as clamps, hoses, pipes, screws, etc.. It is designed and sized in such a way that it snaps instantly onto the existing oil filter. The present invention requires absolutely no modification of the engine or the filter itself, nor does it require tools for installation, and no parts of the vehicle need be removed or modified.

This invention is extremely versatile and will work with any internal combustion engine including marine engines, stationary engines, commercial engines trucks, busses., electrical generators, water pumps, farm equipment or tractors, motorcycles and lawn mowers.

The present invention absorbs approximately 11,000–20,000 btu thereby reducing the oil temperature and cooling the engine. The temperature of the oil cools approximately 15° F.–25° F. in the oil filter. From the oil filter, the cooled oil is circulated to the critical engine components, i.e., the crankshaft, bearings and camshaft journals, thereby extending the engine's life by improving the quality of lubricant reaching these key components as well as reducing the operating temperature of those components. The result is longer engine life, fewer breakdowns, and increased engine efficiency.

BRIEF DESCRIPTION OF THE DRAWINGS

The drawings illustrate the best mode presently contemplated of carrying out the invention. In the drawings.

DETAILED DESCRIPTION OF THE INVENTION

Specifically, this oil filter cooler consists of a circular ring having an arcuate length which is somewhat greater than semicircular, preferably completing an arc of about 225 degrees. The base ring which is adapted to engage the exterior of a filter is at least one inch in width. Integral formed with this ring are a plurality of cooling fins arranged radially. In a preferred embodiment, for example, there were 35 cooling fins provided approximately 6 degrees apart. All of these fins extend approximately one inch from the circumferential perimeter of the ring and may be of equal width to the ring. Preferred thickness dimensions are 0.08 inch for the base ring and tapering from 0.06 inch to 0.025 inch for all the fins. The most preferable material this oil filter cooler ring can be made of is solid aluminum, but other heat conductive metals, for example, brass, could be substituted. Other suitable alternative metals include beryllium, magnesium, iron, copper, zinc, lead, silver, tin, or nickel. Alloys of the aforementioned metals also work well, as would merely plating the ring with the heat conductive metals. The metals may be chemically or electrochemically treated or coated. Whatever the material, it must be slightly flexible to allow the cooler to snap on and off easily and yet remain secure and in place on the filter.

Variations of this design include reducing or increasing the number of cooling fins, arranging the fins spirally or with a variation in shape, direction or size. Changes to the thickness, width or degrees of arc of the base ring may also be made. In the case of some engine types, and to maximize the rate of cooling obtainable, the base ring may be in the form of a split ring which is adapted to substantially surround the filter.

Another variation includes moving the ring from the inside of fins to the outside or any other location as well as adding additional cooling rings to the oil filter or eliminating the ring and adding a continuous circular fin or semi-continuous fin. Additionally, a band can be substituted for the fins.

Figure 1:
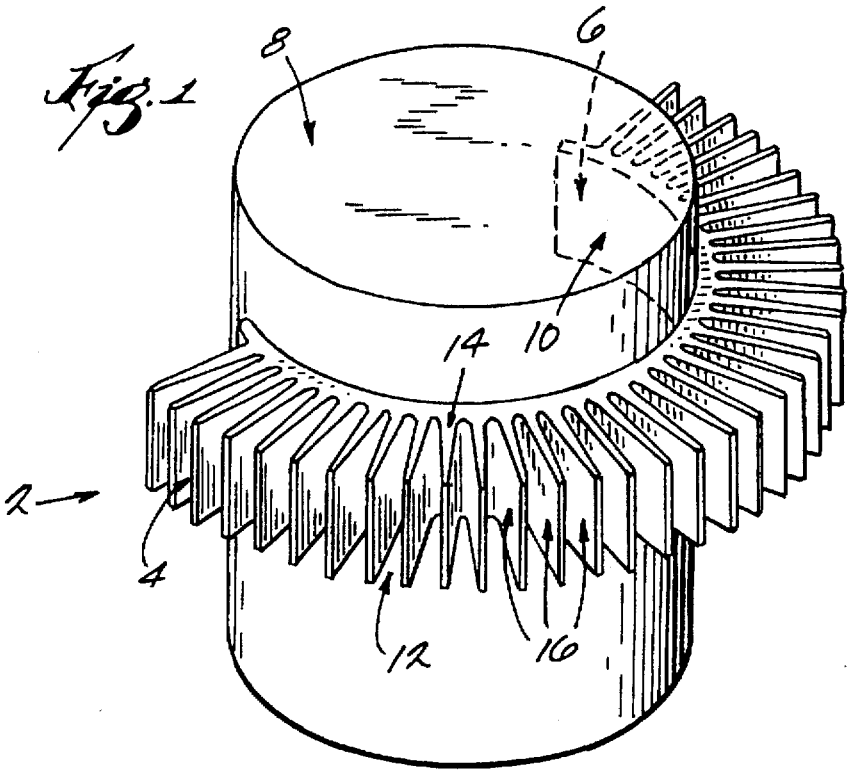
FIG. 1 is a side perspective view of the invention showing an oil filter in phantom.
Figure 2:
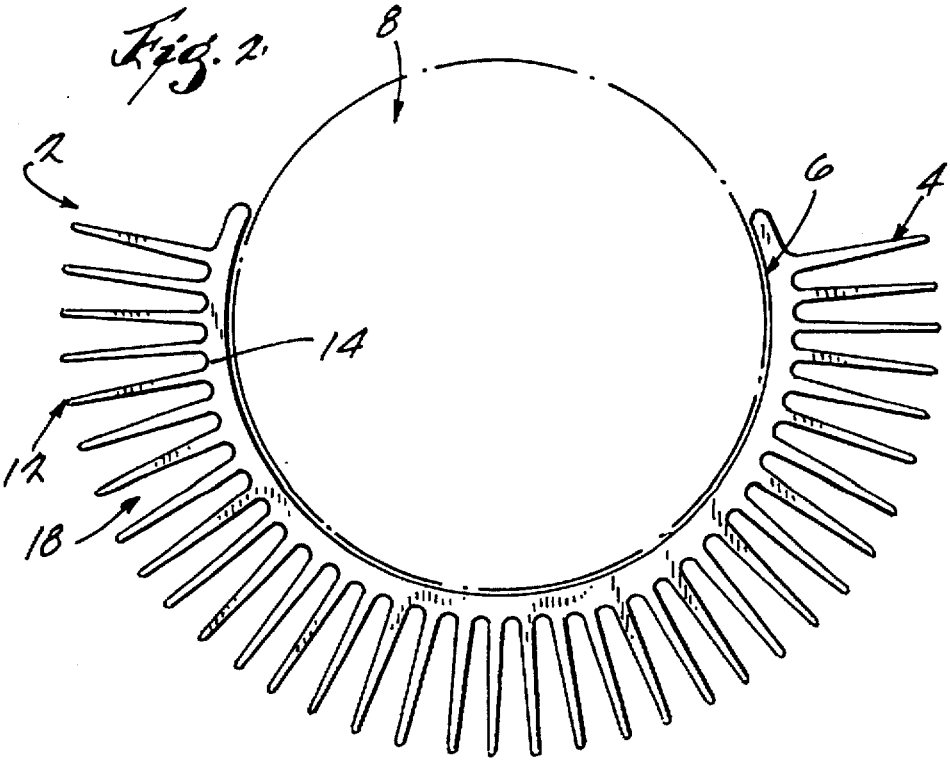
FIG. 2 is a top view of the invention showing an oil filter in phantom; and, FIG. 3 is a perpective view simailar to FIG. 1 showing a further embodiment of the invention.

Referring to FIGS. 1 and 2 of the drawings, an oil filter cooler 2 of this invention is shown in FIG. 1. The oil filter 2 is shown in place around the circumference of an oil filter 8, shown in phantom. The oil filter cooler 2 consists of a multitude of fins 4 projecting outward from base ring 6. The base ring 6 has a width 10.

The fins 4 extend along the entirety of width 10 and along the entire length of base ring 6. Preferably, the fins 4 are either square or rectangular in cross sectional shape, but may also be elliptical, etc. Fins 4 are radially outwardly extending from the base ring and have a tapered end 12 and a standard end 14. The standard end 14 is the end which is continuous with base ring 6 and the tapered end 12 is the end furthest away from base ring 6 and opposite standard end 14. Each fin has two fin sides 16. Each fin side 16 has a planar, flat, or, alternatively, convex and smooth surface.

In between each pair of adjacent fins is a void area 18 where the heat transferred from the oil filter is dissipated into the surrounding environment. Specifically, the heat contained in the oil is transferred from the oil filter's outer circumferential surface to the oil filter band 6, where the heat is then transferred by conduction to each individual fin 4. Each fin side 16 has a large surface area and contacts the surrounding air in the void area 18, where the heat is transferred to the outer environment away from the oil filter. The greater the fin side 16, the greater the surface area, and, therefore, the greater amount of heat which can be drawn away from oil filter 8.

FIG. 2 shows a top view of the oil filter 8 with cooling device 2 situated around oil filter 8. The void area 18 is shown between each fin 4. Base ring 6 is clearly shown as well as tapered end 12 and standard end 14 on each fin 4. As one can see, the oil filter cooler 2 fits firmly around the oil filter. The base ring 6 is slightly flexible so that it can snap onto an oil filter 8 without the use of tools or modifying the oil filter itself. It is important, however, that base ring 6 be only slightly flexible due to the fact that once it is snapped onto the oil filter 8, it must remain in place and not slide off the bottom of the oil filter. Therefore, the oil filter cooler 2 must be flexible, yet firm enough that once it is snapped onto the oil filter 8, it remains firmly in place.

It is important to note that the base ring 6 should not be overly wide, due to the fact that it is important that several of these oil filter coolers 2 may be placed onto one oil filter at the same time. This allows a customized cooling system for the oil filter. For example, if the weather is extremely warm, it may be desirable to put several oil filter coolers 2 onto the oil filter 8. However, as the weather cools, it may be necessary to remove some of the oil filter coolers 2 to reflect the change in temperature. Additionally, in the winter, it may be desirable to remove all of the oil filter coolers 2. This is precisely why the base ring width 6 should range from 0.5 inch to approximately 2.5 inches to accommodate such usage. As one can see, it is important that this oil filter 2 be removable to reflect the changing temperature and that it be simple enough to be placed on and off the oil filter 8 as needed.

Base ring 6 is preferably a circular ring completing approximately 225° to 350° of arc. Width 6 should be approximately one inch and the number of fins 4 should range from approximately 30–40 fins, preferably about 35. The void area 18 should be approximately 6° in between each fin. In other words, the cooling fins 4 should be approximately 6° apart. Fin side 16 may extend approximately one inch outwardly from base ring 6. The width of each fin 4 may be approximately equal to that of base ring 6. The thickness of the base ring 6 may be about 0.08 inch. The standard end 14 of the fin may be approximately 0.06 inch and the tapered end 12 should be appropriately thinner, for example, to 0.025 inch.

Figure 3:
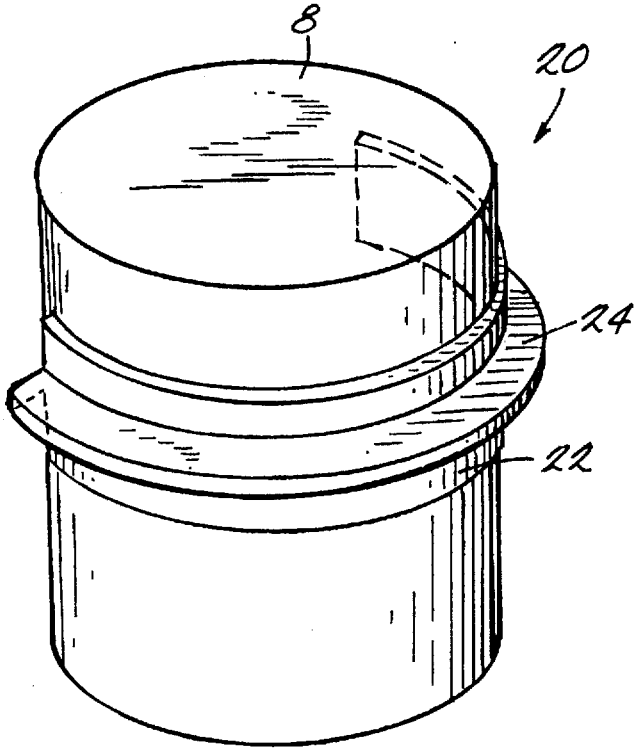

FIG. 3 shows and alternative embodiment wherein cooling device 20 is formed from a base ring 22 to which is attach a single fin in the form of a flange 24. The single protruding flange 24 serves as a heat transfer fin. Flange 24 may either extend along the entire circumferential length of ring 22 or, if desired, part, but not all of that length. Flange 24 may also be provided with a gap, and ring 22 may be formed of two parts hingedly connected to allow for opening up of the ring 22 by pivoting at the hinge to thus provide for installation and removal of a cooling device formed of stiff materials, particularly if all or nearly all of the entire circumference of the oil filter is to be surrounded by the ring 22.

I claim:

1. An oil filter cooler comprising:

a circular, slightly flexible base ring, having a diameter which is adapted to fit in close conformity around at least part of the circumference of an oil filter and has a circumferential length exceeding 180° and wherein said base ring is dimensioned to snap fit onto and to remain in place on, but is removable from said oil filter;

at least one protrusion extending outwardly from said base ring, and, wherein said base ring and said protrusion(s) is at least partially comprised of a heat conductive metal.

2. An oil filter cooler of claim 1 wherein said metal is selected from the group consisting of: aluminum, beryllium, magnesium, iron, copper, zinc, lead, silver, tin, and nickel or an alloy thereof.

3. An oil filter cooler of claim 1 wherein said metal is electrochemically coated onto said base ring and said protrusion(s).

4. An oil filter cooler of claim 1 wherein said protrusion(s) is comprised of one continuous flange.

5. An oil filter cooler of claim 1 wherein said base ring completes approximately 225° to 350° of arc and has a width of approximately 1 inch.

6. An oil filter cooler of claim 5 wherein said base ring and protrusion(s) are comprised of aluminum.

7. An oil filter cooler of claim 6 wherein said protrusion(s) is comprised of a plurality of fins arranged radially and set apart approximately 6°, said fins extending approximately 1 inch from said base ring and each said fin being equal to said base ring width.

8. An oil filter cooler of claim 7 wherein the number of fins is approximately 35.

9. An oil filter cooler of claim 8 wherein said base ring has a thickness of about 0.08 inch.

10. An oil filter cooler of claim 7 wherein said fins taper from about 0.06 inch from the point said fins attach to said base ring tapering toward the opposing end.

11. An oil filter cooler of claim 6 wherein said protrusion (s) is arranged spirally.

12. An oil filter cooler of claim 6 wherein said protrusion (s) is a continuous circular flange.

13. An oil filter cooler of claim 6 wherein said protrusion (s) is a semi-continuous flange.

14. An oil filter cooler comprising:

a circular, slightly flexible base ring having a diameter which is adapted to fit around a major part of the circumference of an oil filter and wherein said base ring is dimensioned to snap fit onto and to remain in place on, and wherein said base ring is removable from said oil filter:

a plurality of protrusions extending outwardly from said base ring: and wherein said base ring and said protrusions comprise a metal selected from the group consisting of: aluminum, beryllium, magnesium, iron, copper, zinc, lead, silver, tin and nickel.

* * * * *